US009115555B2

(12) United States Patent
McMillon et al.

(10) Patent No.: US 9,115,555 B2
(45) Date of Patent: Aug. 25, 2015

(54) MAGNETIC FIELD DOWNHOLE TOOL ATTACHMENT

(71) Applicant: Halliburton Energy Services, Inc., Houston, TX (US)

(72) Inventors: Christopher Michael McMillon, Wylie, TX (US); Adam Wright, Alkhobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 13/911,868

(22) Filed: Jun. 6, 2013

(65) Prior Publication Data

US 2013/0333872 A1 Dec. 19, 2013

Related U.S. Application Data

(63) Continuation of application No. PCT/US2012/043180, filed on Jun. 19, 2012.

(51) Int. Cl.
*H01F 7/04* (2006.01)
*E21B 23/00* (2006.01)
*E21B 23/01* (2006.01)

(52) U.S. Cl.
CPC ..... *E21B 23/00* (2013.01); *E21B 23/01* (2013.01); *H01F 7/04* (2013.01)

(58) Field of Classification Search
CPC ..... E21B 17/028; E21B 23/00; E21B 23/01; H01F 7/04; H01F 17/06; H01F 7/122; G01V 1/40; G01V 1/46
See application file for complete search history.

(56) References Cited

U.S. PATENT DOCUMENTS

| | | | | |
|---|---|---|---|---|
| 5,351,755 | A | 10/1994 | Howlett | |
| 5,864,099 | A | 1/1999 | Wittrisch et al. | |
| 7,012,852 | B2 * | 3/2006 | West et al. | 367/25 |
| 7,048,089 | B2 * | 5/2006 | West et al. | 181/105 |
| 7,187,620 | B2 | 3/2007 | Nutt et al. | |
| 2003/0179651 | A1 * | 9/2003 | Nutt et al. | 367/25 |

OTHER PUBLICATIONS

Foreign communication from the priority application—International Search Report and Written Opinion, PCT/US2012/043180, Feb. 28, 2013, 11 pages.

* cited by examiner

*Primary Examiner* — Yong-Suk (Philip) Ro
(74) *Attorney, Agent, or Firm* — John W. Wustenberg; Baker Botts L.L.P.

(57) ABSTRACT

A magnetic attachment mechanism for use with a downhole tool comprises a plurality of permanent magnets each having a magnetic field, a demagnetizer configured to at least partially cancel one or more magnetic fields in an activated state, an actuator configured to transition the demagnetizer between the activated state and a deactivated state or the deactivated state and the activated state, and at least one downhole tool coupled to the plurality of permanent magnets.

14 Claims, 9 Drawing Sheets

MAGNETIC FIELD DOWNHOLE TOOL ATTACHMENT

CROSS-REFERENCE TO RELATED APPLICATIONS

This application is a continuation of and claims priority to PCT International Application No. PCT/US2012/043180, filed Jun. 19, 2012 and entitled "Magnetic Field Downhole Tool Attachment," which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This invention relates generally to the field of downhole tools in a wellbore, more particularly to a downhole tool attachment mechanism and method via the application of magnetic fields.

In the course of completing an oil and/or gas well, a wellbore is drilled from the earth's surface into a subterranean production zone. Often included in the downhole apparatus are a variety of tools to perform tasks associated with drilling, completion, and maintenance of the wellbore. For example, downhole sensors may be attached to a wellbore to measure various wellbore and subterranean formation parameters including, but not limited to, pressure, temperature, resistivity, and/or porosity. The measurement results may provide important information for an operator on the surface of a rig site to make field-development decisions.

One approach of downhole tool deployment is to attach one or more downhole tools to a wellbore tubular at the surface, and then lower both into the subterranean wellbore together. In this case, once deployed to an appropriate depth, the downhole tools usually remain in the wellbore while the production string remains in the wellbore. They may then be detached or removed from the wellbore when the tubular and/or casing is retrieved to surface.

Alternatively, during drilling and/or maintenance of a well, downhole tools may be deployed into the well via a length of slickline, wireline and/or coiled tubing which is controlled from the surface. For the downhole tool to perform its designed function, it needs to be positioned in the well at an appropriate depth. Following positioning, the downhole tool is then actuated by one of several methods, depending on the type of downhole tool. In this case, the downhole tool is usually raised back to surface after completion of its planned function.

SUMMARY

In an embodiment, a magnetic attachment mechanism for use with a downhole tool comprises a plurality of permanent magnets, wherein each permanent magnet of the plurality of permanent magnets has a magnetic field, a demagnetizer configured to at least partially cancel one or more magnetic fields in an activated state, an actuator configured to transition the demagnetizer between the activated state and a deactivated state, or the deactivated state and the activated state, and at least one downhole tool coupled to the plurality of permanent magnets. The plurality of permanent magnets may be arranged in a radial pattern with a corresponding pole of each magnet aligned at a center of the radial pattern, a matrix pattern with a corresponding pole of each magnet aligned in a parallel direction, or any combination thereof. The plurality of permanent magnets may be coupled to a retainer, and the retainer may comprise one or more surface features configured to increase friction with a surface. The plurality of permanent magnets may be arranged on opposite sides of a clamp mechanism, and the clamp mechanism may be configured to engage a wellbore tubular in the deactivated state. The demagnetizer may comprise an electric coil configured to form an electromagnet. The demagnetizer may be configured to at least partially cancel the magnetic fields of a portion of the plurality of permanent magnets in the activated state, and the demagnetizer may be configured to at least increase the magnetic fields of a portion of the plurality of permanent magnets in the deactivated state.

In an embodiment, a magnetic attachment mechanism for use in a wellbore comprises at least one permanent magnet comprising a first magnetic field, a demagnetizer configured to at least partially cancel the first magnetic field in an activated state, and an actuator configured to transition the demagnetizer between the activated state and a deactivated state, or the deactivated state and the activated state. The demagnetizer may comprise an electric coil configured to form an electromagnet, and the electric coil may be a bifilar coil. The electric coil may be disposed about the at least one permanent magnet. The magnetic attachment mechanism may also include a power source coupled to the demagnetizer, actuator, or both. The actuator may comprise a switch configured to pass an electric current through the coil in a first direction, pass the electric current through the coil in a second direction, or prevent the electric current from passing through the coil. The electric current passing through the coil in the first direction may at least partially cancel the first magnetic field, and the electric current passing through the coil in the second direction may increase the first magnetic field. The demagnetizer may comprise a second permanent magnet comprising a second magnetic field. The actuator may be configured to align the second permanent magnet in a first orientation with respect to the at least one permanent magnet or a second orientation with respect to the at least one permanent magnet. The first orientation may at least partially cancel the first magnetic field, and the second orientation may increase the first magnetic field.

In an embodiment, a method of coupling a component to a structure in a wellbore comprises applying a cancellation field to a permanent magnet, wherein the cancellation field at least partially cancels a magnetic field of the permanent magnet, removing the cancellation field, and coupling the permanent magnet to a structure in a wellbore. The method may also include coupling the permanent magnet to a downhole tool, and wherein coupling the permanent magnet to the structure in the wellbore comprises coupling the downhole tool to the structure in the wellbore. The cancellation field may enable disposing of the downhole tool in the wellbore, and removing the cancellation field may enable coupling of the downhole tool to the structure in the wellbore.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
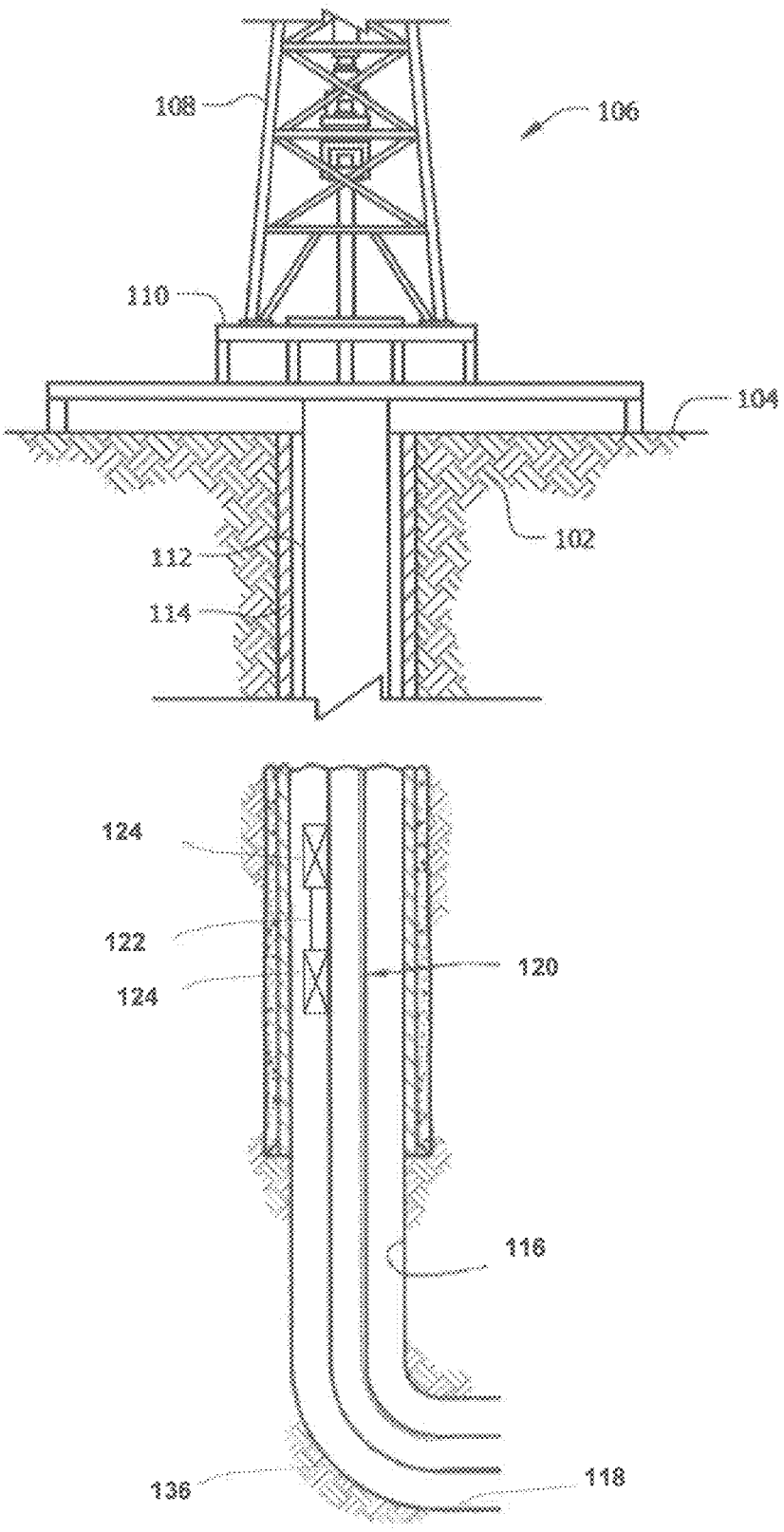
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

There may be potential problems and/or inconveniences associated with previous methods of deploying a downhole tool in a wellbore. In one method, a downhole tool is attached to a wellbore tubular at the surface using mechanisms such as adhesives, screws, and/or clamps. Once the downhole tool is lowered into the wellbore it may be difficult and costly to modify or remove the downhole tool should anything go wrong. In another method, the downhole tool is connected to one end of a wireline or slickline and delivered into a wellbore. However, the downhole tool may not attach reliably to a wellbore structure such as the wellbore tubular. In addition, since the wireline may have to be connected to the downhole tool during the entire time of its operation, the downhole tool may only realistically stay downhole for a limited period of time before it is retrieved to the surface with the wireline.

In order to address these problems, the magnetic attachment mechanism disclosed herein provides a simple and reliable coupling between one or more downhole tools and a structure in the wellbore (e.g., a wellbore tubular). The coupling may be releasable and/or semi-permanent depending on the application. In an embodiment, by disposing an electric coil about a permanent magnet which is coupled to one or more downhole tools, two magnetic fields may overlap—forming a combinatory field. In an activated state of the magnetic attachment mechanism, the second magnetic field—that of the current-flowing electric coil—may at least partially cancel the first magnetic field—that of the permanent magnet—leading to an overall magnetic field with reduced magnitude (e.g., zero or near-zero magnitude). In the activated state, the downhole tool may be free to move within the wellbore without being attracted and engaged with a magnetic component in the wellbore. In a deactivated state, the second magnetic field may cancel the first magnetic field to a lesser degree, may not exist (no current flow), or may act to strengthen the first magnetic field (opposite direction of current flow). Thus, the overall magnetic field in the deactivated state may have a higher magnitude compared to the activated state. As a result, in the deactivated state, the downhole tool may be attracted to and coupled with a magnetic structure in the wellbore.

In an embodiment, the magnetic attachment mechanism comprises a second magnetic field generated by a second permanent magnet instead of an electric coil. Instead of controlling an electric current, suitable mechanical manipulation may be implemented to change the location and/or orientation of the second magnetic field with respect to the first magnetic field. Thus, the second magnetic field may at least partially cancel the first magnetic field in an activated state, and strengthen the first permanent magnetic field in a deactivated state.

Using the magnetic attachment mechanism disclosed herein, a downhole tool may be readily deployed in a wellbore by activating the magnetic attachment mechanism. In this state, the downhole tool may be conveyed within the wellbore without being coupled to a magnetic structure. When the magnetic attachment mechanism is deactivated, the magnetic attachment mechanism may be coupled the downhole tool to a magnetic structure in the wellbore. The downhole tool may remain coupled to the structure for an extended period of time, if needed, without requiring any continuous energy supply. Whenever necessary, the magnetic attachment mechanism may be reactivated to release the downhole tool from the structure, so that the downhole tool may be relocated in the wellbore or retrieved to the surface. For example, the downhole tool may fall to a position below the previous position. At this point, the magnetic attachment mechanism may be deactivated, thereby allowing the downhole tool to attach to a structure in the wellbore. This process may be repeated any number of times to allow the downhole tool to be repositioned within the wellbore as desired.

Referring to FIG. 1, an example of a wellbore operating environment in which a downhole tool may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. It should be understood that the wellbore tubular 120 is equally applicable to any type of wellbore tubular being inserted into a wellbore including, as non-limiting examples, drill pipe, casing, liners, jointed tubing, and/or coiled tubing. In an embodiment, the wellbore tubular 120 may comprise a magnetic material. Further, the wellbore tubular 120 may operate in any of the wellbore orientations (e.g., vertical, deviated, horizontal, and/or curved) and/or types described herein. In an embodiment, the wellbore may comprise a wellbore casing 112, which may be cemented into place in at least a portion of the wellbore 114.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In an embodiment, a downhole tool 122 may be coupled to the wellbore tubular 120 within the wellbore 114. While FIG. 1 illustrates a single downhole tool 122, the wellbore 114 may comprise a plurality of downhole tools 122 with various forms and purposes. Often, performing an operation in the wellbore 114 may require a plurality of different downhole tools. For example, in the completion of a well, a sampling device may sometimes be deployed downhole to collect hydrocarbon samples in a production zone. To ensure that the sampling device may be deployed to its intended location, a position sensor may be coupled to the sampling device to detect its position within the wellbore. When the sampling device reaches its desired position, an actuator, coupled to the sampling device, may be triggered to lock the position of the sampling device, so that sample collection may start. As shown in FIG. 1, the downhole tool 122 may be coupled to a structure in a wellbore via an attachment mechanism 124. The attachment mechanism 124 may comprise a variety of materials, such as adhesives, tapes, curable resins, etc. Also, the attachment mechanism 124 may comprise a variety of devices, such as screws, knobs, and/or clamps, etc.

As discussed above, previous methods of deploying the downhole tool 122 and/or implementing the attachment mechanism 124 may lead to potential problems. In one previous method, the downhole tool 122 is attached to the wellbore tubular 120 via mechanical clamps at the surface. Once the downhole tool 122 is lowered into the wellbore 114, it may remain attached to the wellbore tubular 120. Consequently, should anything go wrong, it may be extremely difficult to modify, repair, or remove the downhole tool 122, while the production string remains in operation. In another previous method, when the downhole tool 122 is connected to one end of a wireline and delivered into the wellbore 114, the downhole tool 122 may not be able to be reliably coupled to a wellbore structure, such as the surface of the wellbore tubular 120. Consequently, certain downhole applications, which require a reliable coupling between the downhole tool 122 and the wellbore tubular 120, may not be conducted. In addition, since the wireline may have to connect the downhole tool 122 during the entire time of its operation, the downhole tool 122 may only realistically stay downhole for a limited period of time before it has to be retrieved to the surface with the wireline. These problems may be avoided or overcome by the disclosed magnetic attachment mechanism, which will be discussed below in detail.

Figure 2:
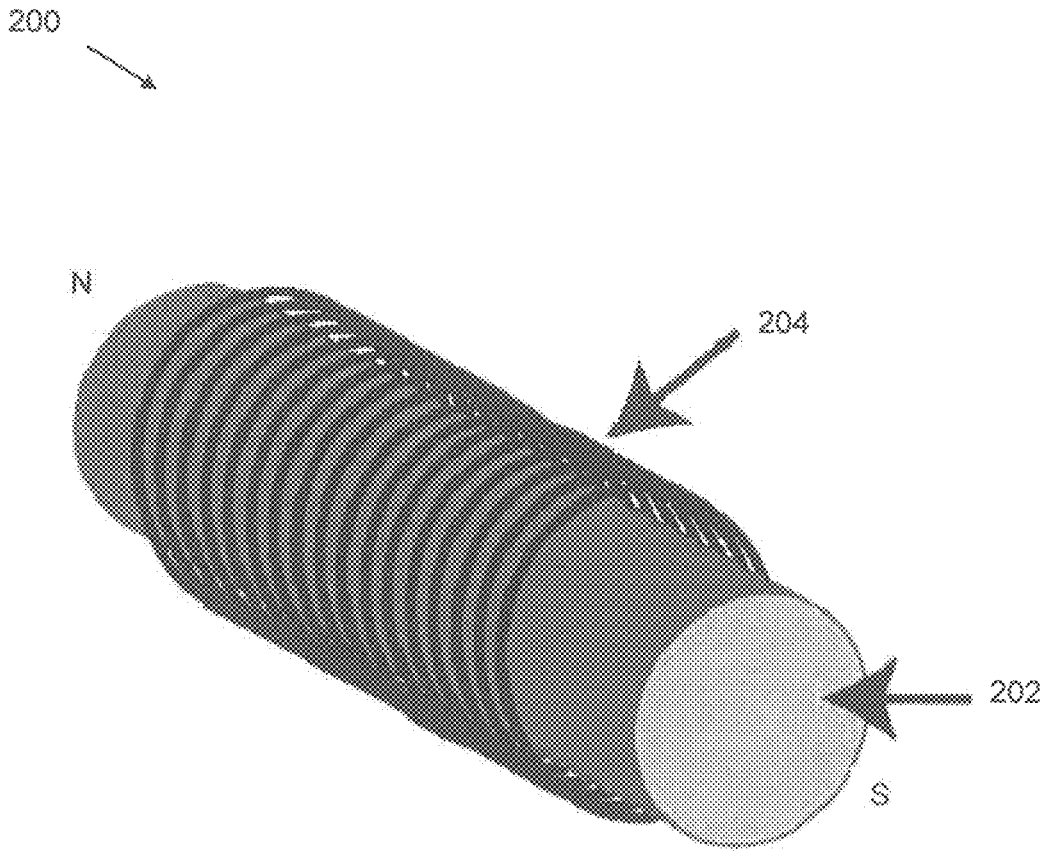
FIG. 2 is a simplified perspective view of an embodiment of a magnetic attachment mechanism comprising a permanent magnet and an electric coil.

A simplified perspective view of an embodiment of a magnetic attachment mechanism 200 is illustrated in FIG. 2. The magnetic attachment mechanism 200 comprises a permanent magnet 202 and an electric coil 204. The permanent magnet 202 may comprise an object that creates its own persistent magnetic field. Any of a number of materials may be magnetized into a permanent magnet, such as iron, nickel, steel, cobalt, etc., which are sometimes referred to as ferromagnetic materials. In the presence of an external magnetic field, a variety of materials (ferromagnetic materials, paramagnetic materials, etc.), which are generally referred to as magnetic materials, show positive susceptibility toward the magnetic field. For example, a wellbore tubular made of steel may be strongly attracted by a permanent magnet. Provided with sufficient attraction force, the permanent magnet may be coupled to the surface of the wellbore tubular without any energy supply.

A magnetic field mathematically describes the magnetic influence of a temporary or permanent magnet. The magnetic field is a vector field meaning that, at any given point in space, it is specified by both a direction and a magnitude. Herein the magnetic field may refer to either the magnetic flux density (B field) or the magnetic field density (H field) which, in most cases, may be closely related by a multiplicative relationship: $B=\mu H$, where $\mu$ is the permeability of a material. The two different ends of a magnet may be referred to as north and south magnetic poles. It should be understood that the concept of magnetic poles may not indicate the physical presence of north and south particles at opposing ends of a magnet. Rather, it may merely be an artificial reference to clarify the direction of a magnetic field. In general, outside a magnet, the direction of its magnetic field may point from the north pole toward the south pole, whereas, inside a magnet, the direction of its magnetic field may point from the south pole toward the north pole.

While FIG. 2 illustrates the permanent magnet 202 in the shape of a cylinder, the permanent magnet 202 may take various geometries (cube, box, cone, torus, pyramid etc.). Likewise, the size of the permanent magnet 202 may be application dependent, as long as a suitable magnetic field may be generated and the attachment mechanism 200 may fit into its ambient environment in a wellbore. In addition, since the attraction between a magnetic material and a nearby magnet may exist regardless of the direction of the magnetic field, the permanent magnet 202 may have a flexible orientation with respect to a wellbore structure, such as the wellbore tubular 120 in FIG. 1. Whether the magnetic field of the permanent magnet 202 is parallel or orthogonal to the surface of the wellbore tubular 120, the two may be coupled together.

The electric coil 204 may be disposed about the permanent magnet 202 to act as an electromagnet. According to Ampere's Circuital Law, the electric coil 204 may produce a temporary magnetic field when an electric current flows through it. The magnetic field may disappear when the current stops. With the application of a direct current (DC), the electric coil 204 may form a magnetic field of constant polarity. When the DC reverses direction, so does the magnetic polarity. The electric coil 204 may be a conventional coil (e.g., a solenoid) with a plurality of turns of a wire arranged side-by-side along the length of the permanent magnet 202. Alternatively, the electric coil 204 may be a bifilar coil comprising two sets of closely-spaced parallel wire windings. Depending on application, any other variant of winding patterns may also be used in the design of the electric coil 204.

A power source supplying current to the electric coil 204 may comprise any device capable of being electrically coupled and/or providing power to the electric coil 204. In an embodiment, the power source may be an on-board DC battery coupled to the attachment mechanism 200. Alternatively, the power source may be located on the rig surface. Current may be delivered to the electric coil 204 through wireless power transmission or a power wireline connected to the electric coil 204. In addition, a downhole generator, such as a fluid turbine, may also be used to provide power to the electric coil 204.

While FIG. 2 illustrates a single electric coil 204, the attachment mechanism 200 may comprise a plurality of electric coils 204. The plurality of electric coils 204 may be disposed about the permanent magnet 202 in a parallel or serial pattern. The plurality of electric coils 204 may be disposed at various locations on the permanent magnet 202, not necessarily covering the entire geometry (length, width, height, or diameter, etc.) of the permanent magnet 202. While FIG. 2 does not show any downhole tool coupled to the attachment mechanism 200, one or more downhole tools may be coupled to the attachment mechanism 200. The number, size and type of downhole tools may be application dependent.

In the implementation of the magnetic attachment mechanism 200 herein, the electric coil 204 may act as a demagnetizer to the permanent magnet 202. In an activated state, the electric coil 204 may generate a second magnetic field that cancels (or at least partially cancels) the first magnetic field generated by the permanent magnet 202. For this reason, in the activated state, the second magnetic field may also be referred to as a cancellation field. In a deactivated state, the second magnetic field may be reduced, non-existent, or may be reversed in direction to strengthen the first magnetic field. The magnetic field generated by the electric coil 204 may have a field pattern that is the same or similar to that of the permanent magnet 202. Since the electric coil 204 may be configured to be concentric with the permanent magnet 202, their magnetic fields may have the same (or opposite) direction at any given point in space. Thus, when the two magnetic fields overlap to form a combinatory magnetic field, the magnitude of the overall magnetic field, at a given point, may simply be the summation or subtraction of the two individual fields.

Specifically, in the activated state of the demagnetizer, the direction of current flow in the electric coil 204 may be configured in such a way that the second magnetic field has an opposite pole direction relative to the first magnetic field. Thus, the magnitude of the overall magnetic field may be approximately the difference between the two magnetic fields. Further, the amount of the current may be configured so that it generates the same magnitude of magnetic field as the permanent magnet 202. Consequently, the overall magnetic field may be completely canceled (or substantially weakened), and the attachment mechanism 200 may not attract a magnetic material anymore. Thus, in the activated state, a downhole tool coupled to the attachment mechanism 200 may be conveyed within the wellbore.

In the deactivated state of the demagnetizer, the current in the electric coil 204 may be reduced or turned off. Consequently, the second magnetic field may reduce in magnitude or disappear, and the first magnetic field may retain its attraction of magnetic materials. A downhole tool coupled to the attachment mechanism 200 may then be attached to a magnetic structure in the wellbore. In some embodiments, the first magnetic field alone may not be strong enough to hold the magnetic attachment mechanism 200 onto the surface of the wellbore structure. In this case, the current in the electric coil 204 may be reversed to have an opposite direction of the activated state. Thus, the magnitude of the overall magnetic field may be approximately the sum of two individual fields. The overall magnetic field may be stronger than the first magnetic field, depending on the amount of current in the electric coil 204. A downhole tool attached to the attachment mechanism 200 may be coupled to the wellbore structure.

The magnetic attachment mechanism 200 may be deployed to various locations and attached to various structures within the wellbore. For example, the magnetic attachment mechanism 200 may be positioned between the wellbore casing 112 and the wellbore tubular 120 in FIG. 1, and coupled to either the wellbore casing 112 or the wellbore tubular 120, depending on application. For another example, the magnetic attachment mechanism 200 may be located inside the wellbore tubular 120 attached to its inner surface. In addition, the magnetic attachment mechanism 200 may be enclosed in a package or housing together with a downhole tool. In this case, the magnetic attachment mechanism 200 may be attached to a wellbore structure indirectly. As a result, the package or housing may protect the magnetic attachment mechanism 200 and/or the downhole tool from potential damages caused by contact with certain substances in its ambient environment, such as oil, gas, water, and mud flows.

An assembly comprising the magnetic attachment mechanism 200, a downhole tool, and/or package may be located in the presence of a fluidic flow. In this case, the overall magnetic field of the magnetic attachment mechanism 200 may be configured to have sufficient magnitude, so that the assembly may withstand the force imposed by the fluidic flow. Without sufficient magnitude of the magnetic field, the assembly may be moved or flushed away from its original location. To secure the coupling between the assembly and its corresponding wellbore structure, the current flow in the electric coil 204 may be configured to increase the amplitude of the overall magnetic field in the deactivated state of the demagnetizer.

The magnetic attachment mechanism 200 may comprise one or more surface features designed to increase friction force between the magnetic attachment mechanism 200 and a surface. For example, the surface of the permanent magnet 202 may comprise corrugations, castellations, scallops, and/or other features, which in an embodiment, may be aligned generally parallel to the longitudinal axis of the wellbore tubular 120. The corresponding outer surface of the wellbore tubular 120 may comprise corresponding surface features to increase friction.

The attachment mechanism 200 may further comprise an actuator configured to control the state of the current in the electric coil 204, thereby transitioning the demagnetizer between the activated state and the deactivated state, and/or the deactivated state and the activated state. In an embodiment, the actuator may simply be a switch controlling the direction of the current, as well as its on/off state. The actuator may be coupled to the attachment mechanism 200, or it may be located at a remote location. For example, the actuator may communicate with the magnetic attachment mechanism 200 from the surface via any suitable wired or wireless communication technique. In order to properly transition between the activated state and the deactivated state, the actuator may be configured to respond to an input generated by various devices such as a timer and a sensor.

In practice, a residual magnetic field with a small magnitude may sometimes be present in the activated state of the demagnetizer. For example, the demagnetizer may not be able to fully cancel the first magnetic field. For another example, after an extended period of coupling to the permanent magnet 202, a wellbore structure comprising a ferromagnetic material may carry some magnetism in the surface areas close to the permanent magnet. The potential issue of residual magnetic field in the activated state may be simply overcome by adjusting the amplitude of the current in the electric coil 204. Alternatively, an initial external force may be applied to the magnetic attachment mechanism 200 to facilitate its movement. For example, the wireline may be coupled to the magnetic attachment mechanism 200, and slightly pulled by a rig operator to displace it from an original location.

Figure 3B:
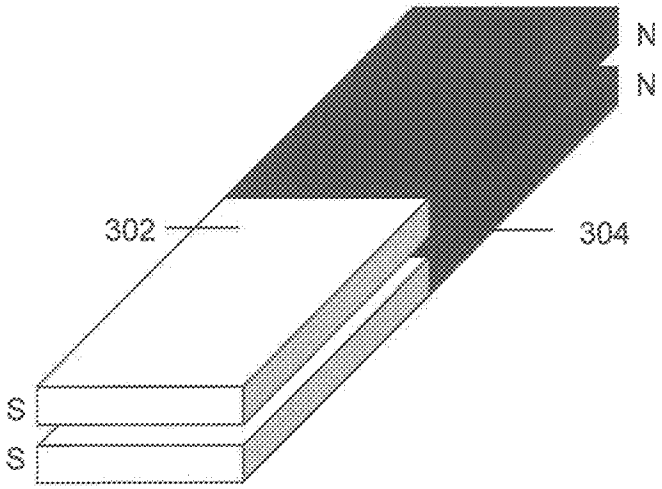
FIGS. 3A-3B are simplified perspective views of another embodiment of a magnetic attachment mechanism comprising a first permanent magnet and a second permanent magnet.
Figure 3A:
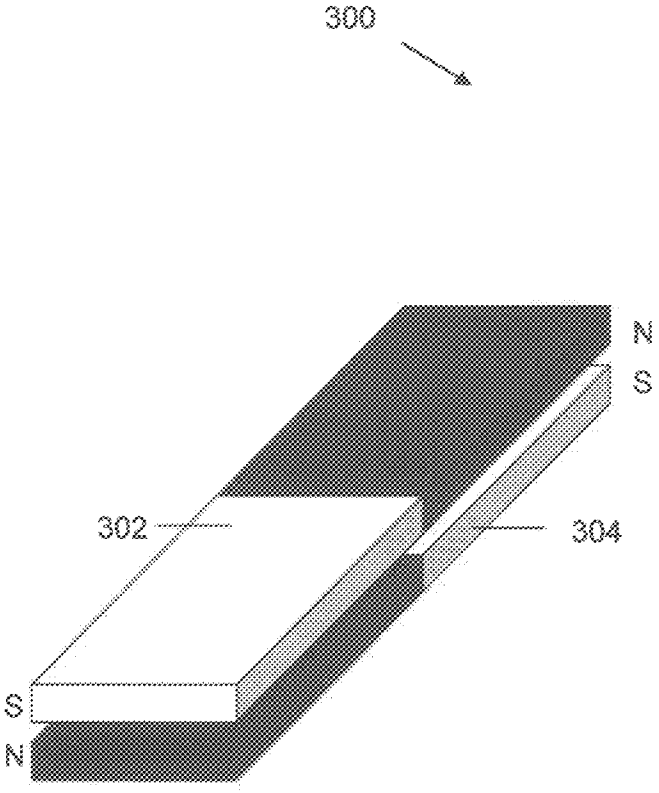

The attachment mechanism may be configured to use a second magnetic field to partially cancel, fully cancel, or increase a first magnetic field. In an embodiment, the second magnetic field may not necessarily be generated by an electric coil. Rather, the second magnetic field may be generated, for example, by a second permanent magnet. FIGS. 3A and 3B show simplified perspective views of an embodiment of a magnetic attachment mechanism 300 comprising a first permanent magnet 302 and a second permanent magnet 304. Since various aspects of the magnetic attachment mechanism 300 may be similar to the attachment mechanism 200, the similar aspects will not be further described in the interest of clarity. Each permanent magnet herein is illustrated in the shape of a rectangular box. For visual clarification, each permanent magnet is marked with a first section denoting a north pole and a second section denoting a south pole. It should be understood that the marked sections merely represent an approximate part of the permanent magnet close to a corresponding pole. For example, the first section marked on the permanent magnet 302 may represent an approximate part that is closest to its north pole. Further, the boundary between the section of the north pole and the section of the south pole may not be taken literally as a flat plane at the center of the rectangular box.

In an embodiment, the first permanent magnet 302 creates a first magnetic field and the second permanent magnet 304 creates a second magnetic field. The second permanent magnet 304 may be referred to as a demagnetizer of the attachment mechanism 300, and the second magnetic field may be referred to as a cancellation field in an activated state of the demagnetizer. The second permanent magnet 304 may comprise the same or different makeups, in terms of material, geometry, magnetic strength, etc., from the first permanent magnet 302. In the activated state, as shown in FIG. 3A, the second permanent magnet 304 may be aligned to the first permanent magnet 302 in such a way that the poles of the second magnetic field may be in opposite direction with respect to the first magnetic field. Due to the near zero distance (or relatively small distance) between the two permanent magnets, their magnetic fields may overlap. Essentially, at a given point in the vicinity of the permanent magnets, the first magnetic field and the second magnetic field may have equal (or near equal) magnitude with opposite (or near opposite) directions. Consequently, the magnitude of the overall magnetic field may be canceled, or at least partially canceled, for the spatial region of interests. As a result, the attachment mechanism 300 may be readily disposed in the wellbore without being coupled to a wellbore structure.

FIG. 3B shows a deactivated state of the attachment mechanism 300, which corresponds to the activated state shown in FIG. 3A. In the deactivated state, the second permanent magnet 304 may be realigned (e.g., reversed in direction) with respect to the first permanent magnet 302, so that the poles of the second magnetic field are in the same (or nearly the same) direction as the first magnetic field. Due to the near zero distance (or relatively small distance) between the two permanent magnets, their magnetic fields may overlap. Essentially, at a given point in the vicinity of the permanent magnets, the first magnetic field and the second magnetic field may have equal (or near equal) magnitude with similar (e.g., nearly identical) directions. Consequently, the overall magnetic field may increase in magnitude. For example, if the permanent magnet 304 is the same or similar to the permanent magnet 302, for certain regions of interests the magnitude of the overall magnetic field may approximately double, relative to that of an individual magnetic field. As a result, in the deactivated state, the attachment mechanism 300 may be coupled to a magnetic wellbore structure.

The attachment mechanism 300 may further comprise an actuator configured to control the orientation of the second permanent magnet 304 with respect to the first permanent magnet 302. Instead of controlling an electric current, the actuator herein may manipulate the demagnetizer (i.e. the second permanent magnet 304) mechanically to transition between the activated state and the deactivated state. The mechanical manipulation may be implemented via any suitable technique. For example, the actuator may comprise a rotating mechanism connected to the second permanent magnet 304. The rotating mechanism may be configured to lock the second permanent magnet 304 to be in the opposite direction to the first permanent magnet 302 in the activated state, and rotate the second permanent magnet 304 for 180 degrees to reverse its polarity in the deactivated state. A device, such as a timer and a sensor, may be used to trigger actions of the actuator. For example, the actuator may rely on a number of inputs such as pressure signals and/or electrical signals to perform actuation.

Alternatively, the attachment mechanism 300 may further comprise an actuator configured to translate the location of the second permanent magnet 304 with respect to the first permanent magnet 302. In an embodiment, the actuator may comprise a translation mechanism coupled to the second permanent magnet 304. In the activated state, the translation mechanism may be configured to align the second permanent magnet 304 to be in close proximity of the first permanent magnet 302 and with opposite magnetic orientation with respect to the first permanent magnet 302. In the deactivated state, the translation mechanism may be configured to move the second permanent magnet 304 away from the first permanent magnet 302. For example, while the location of the first permanent magnet 302 is fixed, the translation mechanism may lift up or lower down the second permanent magnet 304 along the wellbore, so that the second magnetic field may not overlap with the first magnetic field anymore. A suitable device, such as a timer and a sensor, may be used to trigger actions of the actuator.

Figure 4B:
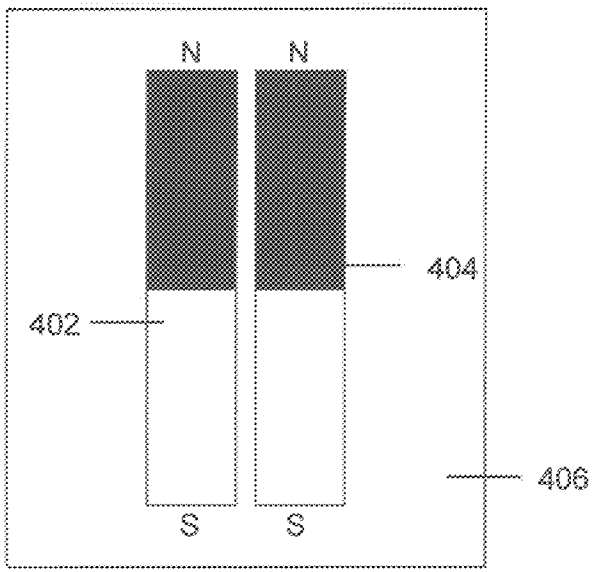
FIGS. 4A-4B are cross-sectional views of another embodiment of a magnetic attachment mechanism comprising a first permanent magnet, a second permanent magnet, and a retainer.
Figure 4A:
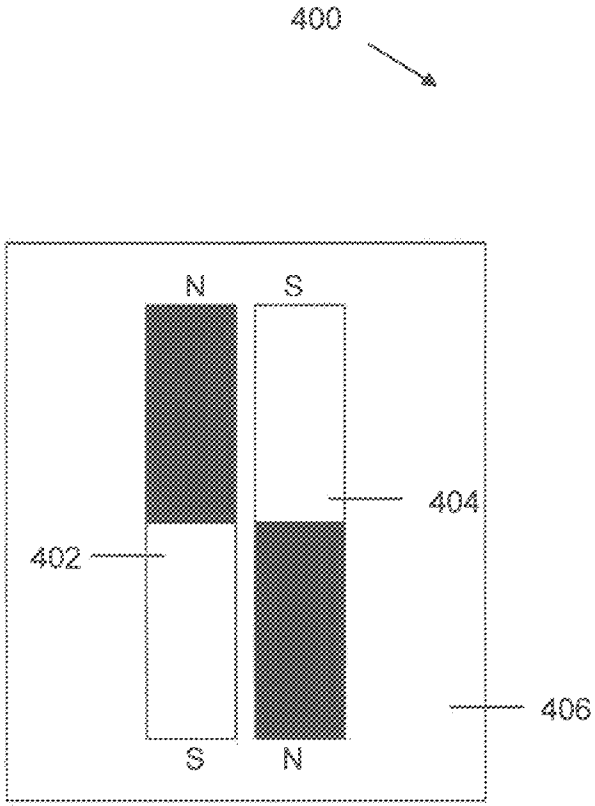

In a magnetic attachment mechanism comprising a plurality of closely arranged permanent magnets, the permanent magnets may naturally repel or attract one another depending on their relative orientations. To prevent potential undesirable movement of permanent magnets, a retainer may be used to construct a physical barrier between the permanent magnets. FIGS. 4A and 4B show cross-sectional views of an embodiment of a magnetic attachment mechanism 400 comprising a first permanent magnet 402, a second permanent magnet 404, and a retainer 406. FIG. 4A illustrates an activated state of the demagnetizer (i.e. the second permanent magnet 404), and FIG. 4B illustrates a deactivated state of the demagnetizer. The magnetic attachment mechanism 400 may be similar to the magnetic attachment mechanism 300. Accordingly, similar components will not be further described in the interest of clarity.

The retainer 406 may serve as a supporting platform for the permanent magnets 402 and 404. In an embodiment, the permanent magnet 402 may be fixed in a position on the retainer 406. While illustrated as being fixed in position, the permanent magnet 402 may be retained in position using any of a variety of retaining mechanisms. Suitable retaining mechanisms may include, but are not limited to, screws, adhesives, curable components, spot welds, any other suitable retaining mechanisms, and any combination thereof. The permanent magnet 404 may be confined to the retainer 406, but may be configured to keep some degree of flexibility so that the permanent magnet 404 may, for example, still rotate and/or translate with respect to the permanent magnet 402.

The retainer 406 may comprise a variety of materials including, but not limited to, elastomers, plastics, polymers, metals, and other suitable materials, and any combination thereof. For example, the retainer 406 may be made of a flexible elastomer (e.g., polydimethylsiloxane) which easily conforms to a non-planar surface, such as the cylindrical surface of the wellbore tubular 120 in FIG. 1. Also, the retainer 406 may take various sizes and shapes (e.g., box, cylinder, irregular shape, etc.). In addition, the retainer 406 may comprise one or more surface features designed to increase friction force between the magnetic attachment mechanism 400 and a surface. For example, the surface of the retainer 406 may comprise corrugations, castellations, scallops, and/or other features, which in an embodiment, may be aligned generally parallel to the longitudinal axis of the wellbore tubular 120. The corresponding outer surface of the wellbore tubular 120 may comprise corresponding surface features to increase friction.

While each of FIGS. 2-4 shows only one first magnetic field (i.e. permanent magnet) and one second magnetic field (i.e. demagnetizer), the magnetic attachment mechanism disclosed herein may comprise a plurality of permanent magnets and/or a plurality of demagnetizers. The plurality of first and second magnetic fields may combine to form a net magnetic field that functions in a similar fashion to a pair of first and second magnetic fields. A variety of examplary configurations of a magnetic attachment mechanism 500 are shown in FIGS. 5A-5D, which may comprise a plurality of permanent magnets 502, electric coils 504, and retainers 506. Herein, various components such as the permanent magnets 502, the electric coils 504 and the retainers 506 may be similar to those described in previous figures, thus the similar aspects of these components will not be further described in the interest of clarity.

Figure 5B:
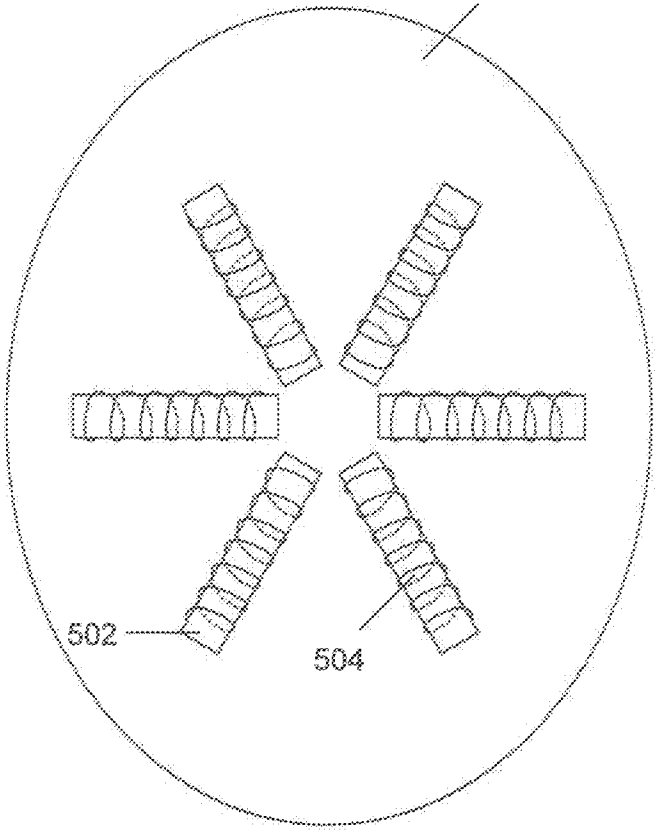
FIG. 5A-5D are cross-sectional and simplified perspective views of another embodiment of a magnetic attachment mechanism comprising a plurality of permanent magnets, electric coils, and retainers.
Figure 5A:
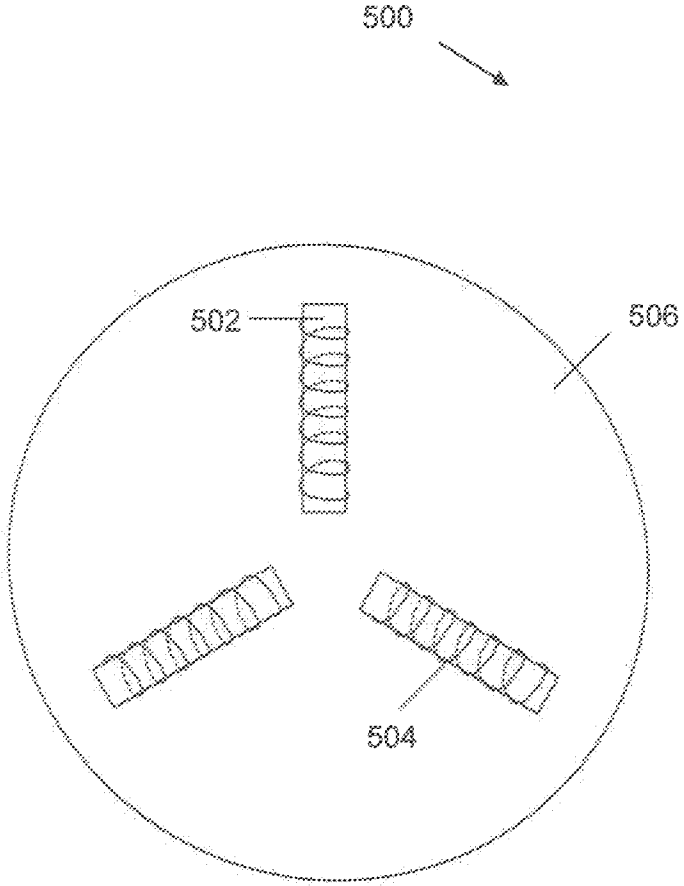

As shown in FIG. 5A, each of a plurality of permanent magnets 502 may have an electric coil 504 disposed thereabout, forming a magnet-coil pair. The plurality of magnet-coil pairs may be arranged in a circular pattern on the circular retainer 506, with a corresponding pole of each permanent magnet 502 aligned at a center of the circular pattern. While FIG. 5A illustrates three permanent magnets, any plurality of permanent magnets may be present.

As shown in FIG. 5B, each of six permanent magnets 502 may be disposed about by an electric coil 504, forming a magnet-coil pair. The six magnet-coil pairs may be arranged in a radial pattern on the oval-shaped retainer 506, with a corresponding pole of each permanent magnet 502 aligned at a center of the radial pattern.

Figure 5D:
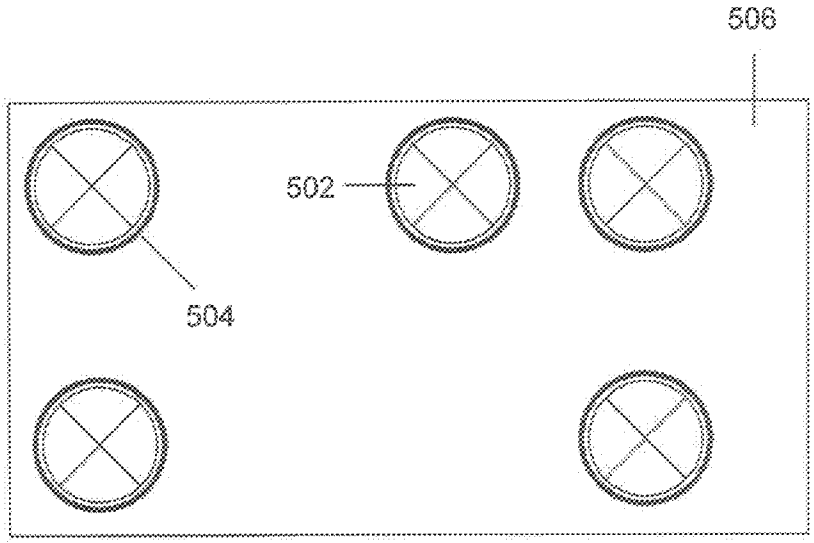
Figure 5C:
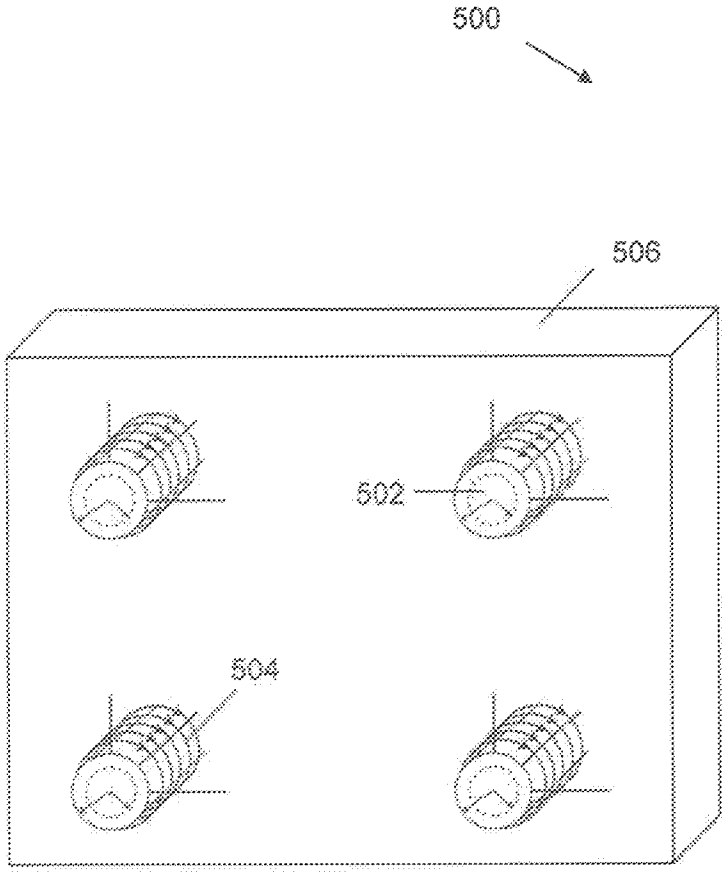

As shown in FIG. 5C, each of four permanent magnets 502 may be disposed about by an electric coil 504, forming a magnet-coil pair. The four magnet-coil pairs may be arranged in an array (or matrix) pattern and affixed within the rectangle-shaped retainer 506, with a corresponding pole of each permanent magnet 502 aligned in a parallel direction.

As shown in FIG. 5D, each of five permanent magnets 502 may be disposed about by an electric coil 504, forming a magnet-coil pair. The five magnet-coil pairs may be arranged in an array (or matrix) pattern on the rectangle-shaped retainer 506, with a corresponding pole of each permanent magnet 502 aligned in a parallel direction.

From FIGS. 5A-5D, it may be noted that the number of magnet-coil pairs in the magnetic attachment mechanism 500 may be flexible depending on application. Also, the arrangement pattern of magnet-coil pairs may be flexible. For example, the magnet-coil pairs may be radially symmetrical (5A-5B), linearly symmetrical (5C), or asymmetrical (5D). In addition, the pole direction of the magnet-coil pairs may be aligned in various angles. For example, the corresponding pole of each permanent magnet may be aligned at a center of a radial pattern (5A-5B), or in a parallel direction (5C-5D) facing a same or an opposite direction. If desired, the pole directions of magnet-coil pairs may be configured to intersect at any angle. In addition, while FIGS. 5A-5D illustrate each permanent magnet 502 with a corresponding electric coil 504, in practice, the number of permanent magnet may not necessarily equal the number of electric coils. A plurality of electric coils may be disposed about one permanent magnet, or alternatively, one electric coil may be disposed about a plurality of permanent magnets. In addition, each of the plurality of permanent magnets or electric coils may comprise different materials, sizes and/or geometries.

The retainer 506 may take a variety of shapes and/or sizes. For example, the retainer 506 may be a (thin or thick) circular cylinder (5A), an oval cylinder (5B), a square box (5C), a rectangular box (5D), an arbitrary geometry, or any combination thereof. Also, the retainer 506 may comprise any structural material, such as a flexible polymer which may conform easily to a non-planar surface. In addition, the retainer 506 may comprise one or more surface features designed to increase friction between the attachment mechanism and a surface.

The power source of the plurality of electric coils 504 may be electrically coupled to the electric coils 504, on-board the retainer 506, and located on the surface with power transmitted wirelessly or via wirelines. There may be a separate power source for each electric coil 504, or a common power source for some or all of the electric coils 504. Likewise, there may be a separate actuator for each demagnetizer, or a common actuator for some or all of the demagnetizers. While the magnetic attachment mechanism 500 does not show the plurality of second magnetic fields (i.e. demagnetizers) to be created by a plurality of permanent magnets, the magnetic attachment mechanism 500 may comprise a plurality of permanent magnets working as demagnetizers.

Figure 6:
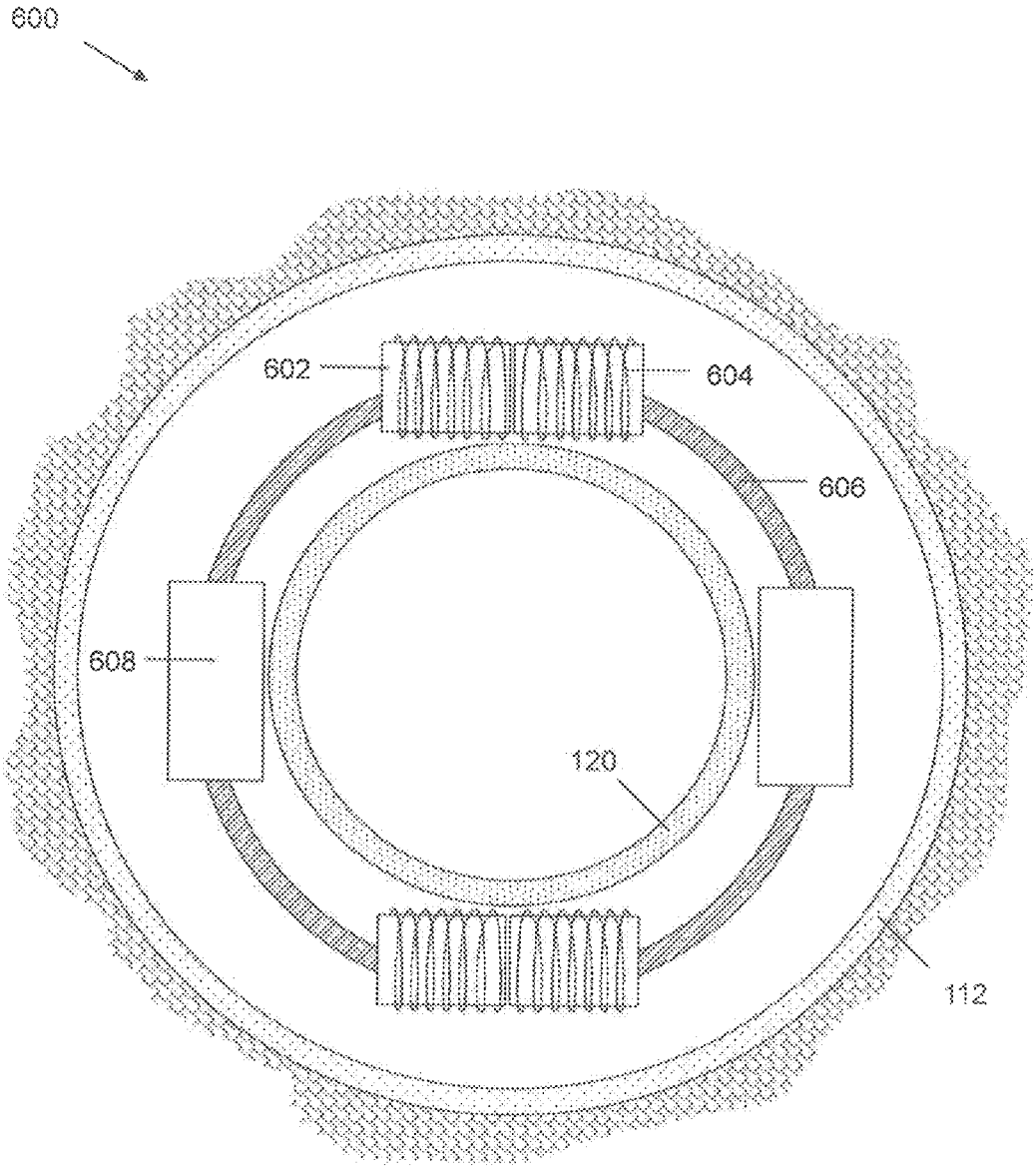
FIG. 6 is a schematic view of another embodiment of a magnetic attachment mechanism comprising a clamp mechanism around a wellbore tubular.

FIG. 6 illustrates a schematic view of an embodiment of a magnetic attachment mechanism 600 located between the wellbore casing 112 and the wellbore tubular 120, while being clamped onto the outer surface of the wellbore tubular 120. The magnetic attachment mechanism 600 may comprise two sides. Suppose, for the purpose of illustration, that each side comprises two pairs of a permanent magnet 602 and an electric coil 604 (may be referred to as magnet-coil pair), and two connectors 606 which may connect a downhole tool 608 to the two magnet-coil pairs. As shown in FIG. 6, the two corresponding permanent magnets on opposite sides of the magnetic attachment mechanism 600 may be configured to have opposite poles facing each other (e.g., a north pole facing a south pole). Thus, in a deactivated state of the demagnetizer (e.g., no current flow in electric coils 604), the two corresponding permanent magnets may naturally attract each other. Thereby, the magnetic attachment mechanism 600 may be clamped securely around the wellbore tubular 120.

For downhole deployment of the magnetic attachment mechanism 600, its two sides may be lowered into the wellbore. When the intended depth of the magnetic attachment mechanism 600 is reached, the demagnetizers may be deactivated and the two sides may attract each other, thus engaging the wellbore tubular 120. Alternatively, the two sides may be loosely coupled together (e.g., via a belt) on the surface. When the intended depth of the magnetic attachment mechanism 600 is reached, the demagnetizers may be deactivated and the two sides may be secured on the wellbore tubular 120.

Since the clamp mechanism relies on attraction between the two sides of the magnetic attachment mechanism 600, the wellbore tubular 120 may not necessarily comprise a magnetic material. Rather, any suitable material may be used for the construction of the wellbore tubular 120. The structural flexibility of the clamp mechanism may prove useful for a wellbore comprising a non-magnetic tubular. The number, shape, size and material of the connectors 606 may be flexible, as long as a secure coupling of magnet-coil pairs and the downhole tool 608 may be achieved. Also, the downhole tool 608 may take a variety of forms, depending on its type and purpose. In addition, the two sides of the magnetic attachment mechanism 600 may be different. For example, one side may not include a downhole tool while the other side may include a plurality of downhole tools.

While each of FIGS. 2-6 shows only one type of demagnetizer (either electrical coil or permanent magnet) in a magnetic attachment mechanism, it should be noted that a plurality of demagnetizer types may be used. For example, in a magnetic attachment mechanism such as the magnetic attachment mechanism 300 in FIG. 3A, the demagnetizer may comprise a permanent magnet and one or more electric coils disposed thereabout. In this case, the cancellation field may comprise a temporary magnetic field and a permanent magnetic field, both of which overlap to affect the first permanent magnetic field. Additionally, in a magnetic attachment mechanism comprising a plurality of demagnetizers such as the magnetic attachment mechanism 600 in FIG. 6, a portion or all of the demagnetizers may comprise both a temporary magnetic field and a permanent magnetic field.

In the completion of a wellbore, a wide variety of downhole tools may be used to perform various functions. For example, drilling tools may dig the wellbore to reach production zones of interest; sampling devices may collect rock, oil and/or gas samples; sensors may monitor various subterranean parameters including, but not limited to, pressure, temperature, vibration, resistivity, porosity, etc. The downhole tools may provide important information for an operator on the surface of a rig site to make field-development decisions. An examplary case of deployment of a downhole tool using a disclosed magnetic attachment mechanism is discussed below.

A downhole data communication system (e.g., the Dynalink Telemetry System available from Halliburton Energy Services of Houston, Tex.) may provide oil and gas operators with wireless data communication. This type of system may operate as a wireless sensor and actuator network that utilizes acoustic energy in the tubing string for data transmission, and downhole applications may be performed without any wireline intervention. In operation, data from downhole sensors may be packaged by the system's electronics. Then the data may travel along the tubing string bidirectionally, allowing real-time communication from the bottom of the wellbore to the surface, or vice versa.

Various downhole tools such as sensor devices may be included in the downhole apparatus to perform tasks such as testing of pressure, temperature, shock, and vibration, etc. In an embodiment, a downhole tool, such as a temperature sensor, may be coupled to a wellbore structure, such as the outer surface of the wellbore tubular 120 in FIG. 1, using a magnetic attachment mechanism, such as the magnetic attachment mechanism 200 in FIG. 2. In this case, the temperature sensor may be first coupled to the magnetic attachment mechanism 200 on the surface. To ensure deployment of the temperature sensor to its intended location, an additional depth or position sensor may also be included in the attachment mechanism 200 to monitor its location. Then, the whole assembly may be attached to one end of a slickline and lowered into the wellbore. Initially, the demagnetizer (i.e. the electric coil 204) may be activated, and an actuator (e.g., a simple switch) may turn on the current in the electric coil 204. Thus, the magnetic attachment mechanism 200 may have zero or near zero overall magnetic field, and the whole assembly may freely move along the length of the wellbore tubular 120. The actuator may continuously receive input from the position sensor. Once the position sensor detects that the assembly has reached its intended location, the demagnetizer may be deactivated. For example, the actuator may simply be triggered to turn off the current in the electric coil 204. Consequently, the magnetic field of the permanent magnet 202 may couple the assembly including the temperature sensor to the wellbore tubular 120. The slickline and/or any current supplying wireline may then break away from the magnetic attachment mechanism 200. If needed, the temperature sensor may remain downhole for an extended period of time (almost permanently) performing temperature measurements, without any continuous energy supply to hold its position.

In one case, if the downhole sensor needs to be retrieved back to the surface for whatever reason, the demagnetizer may be reactivated (e.g., switch on current in the electric coil 204). As a result, the sensor may be released from the surface of the wellbore tubular 120. In another case, if the sensor needs to be relocated to a different depth on the wellbore tubular 120 for additional measurements, the demagnetizer may be first reactivated so that the sensor may be released.

Then, the whole assembly may be disposed in the wellbore until the position sensor detects that a desired new intended location has been reached. After that, the demagnetizer may be deactivated, and the sensor may be re-coupled to the wellbore tubular 120.

Figure 7:
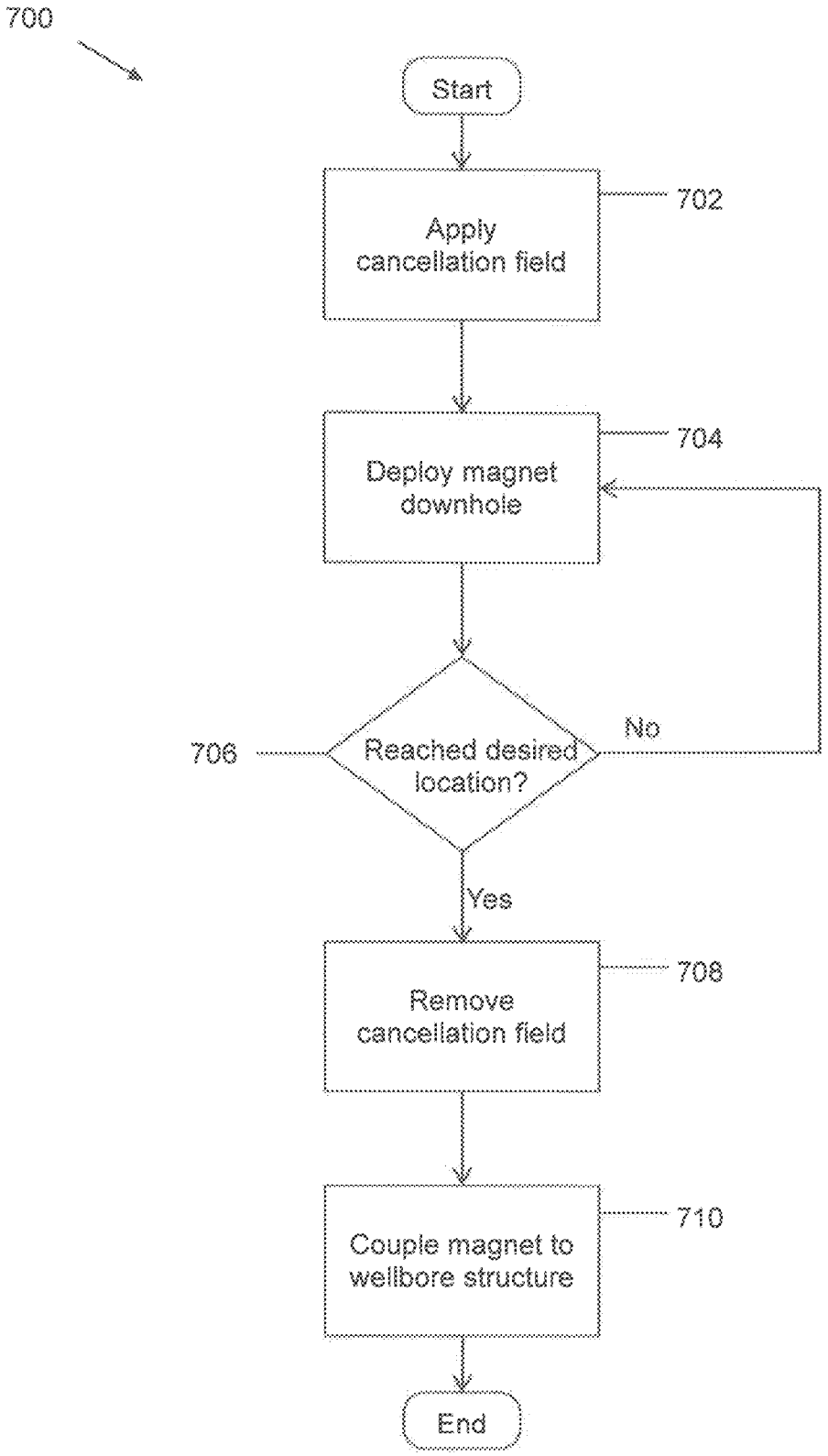
FIG. 7 is a flowchart of a method of coupling a permanent magnet to a structure in a wellbore.

FIG. 7 illustrates a flowchart of a general method of coupling a permanent magnet to a structure in a wellbore. Method 700 starts in step 702, where a cancellation field may be applied to the permanent magnet. The cancellation field may at least partially cancel the magnetic field of the permanent magnet. The cancellation field may be created by an electromagnet, such as an electric coil, or another permanent magnet. Next in step 704, the permanent magnet may be deployed from the surface into the wellbore. The location of the permanent magnet may be monitored via a sensor or any other suitable device. Next in step 706, the method 700 may determine whether a desired location has been reached. If the condition in the step 706 is satisfied, the method 700 may proceed to step 708. Otherwise, the method 700 may proceed to step 704. In step 708, the cancellation field may be removed by deactivating an electromagnet, such as turning off the current of an electric coil, or changing the pole direction of another permanent magnet. Next in step 710, the permanent magnet may be coupled to the structure in the wellbore at the desired location.

Figure 8:
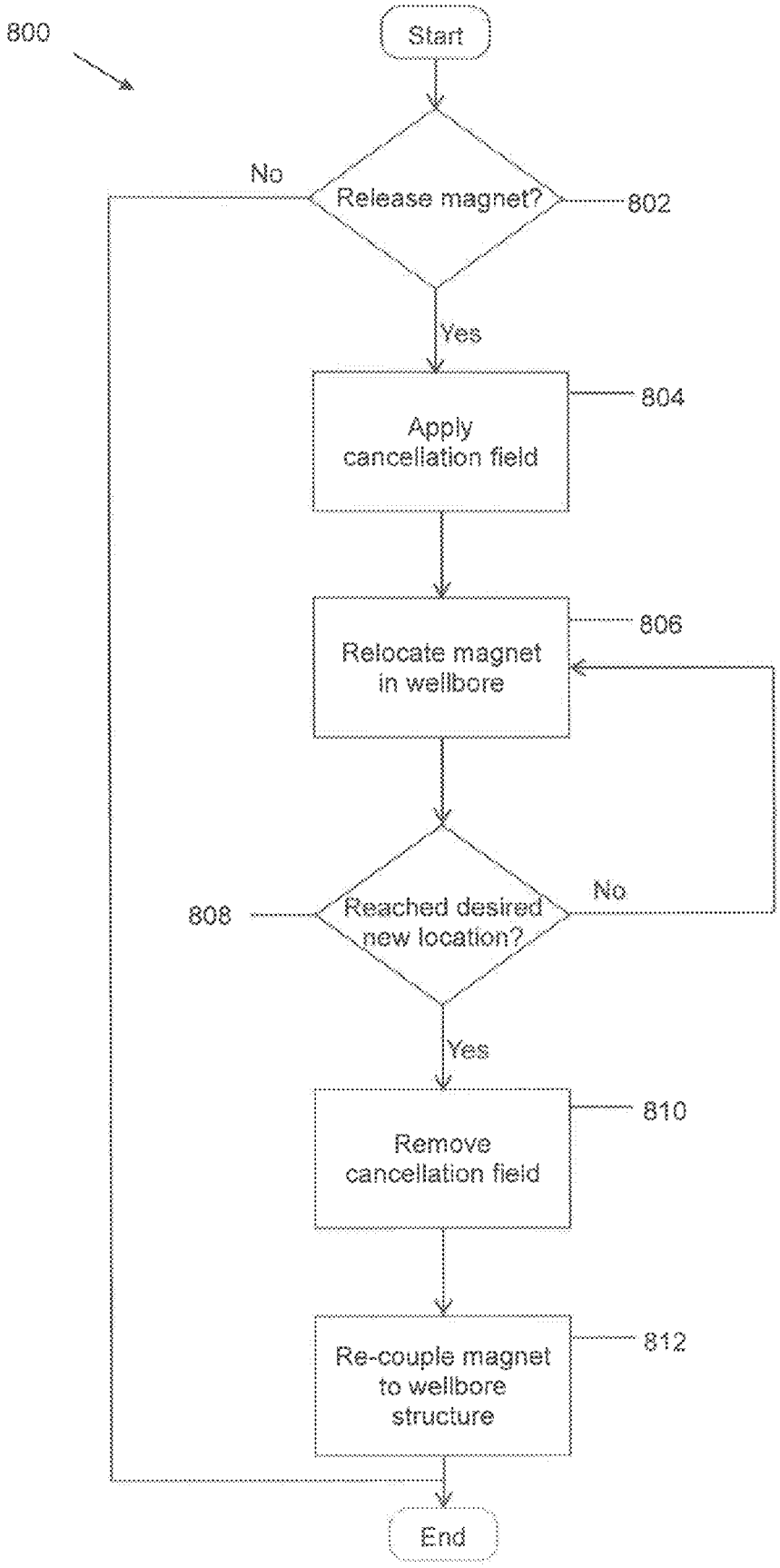
FIG. 8 is a flowchart of a method of relocating a permanent magnet to a new location in a wellbore.

In use, a permanent magnet coupled to a structure in a wellbore may need to be relocated to a new location downhole. FIG. 8 illustrates a flowchart of a general method of relocating a permanent magnet to a new location in a wellbore. Method 800 starts in step 802, where the method 800 may determine whether the coupled permanent magnet needs to be released from its original location in the wellbore. If the condition of step 802 is satisfied, the method 800 may proceed to step 804. Otherwise, the method 800 may end. In step 804, a cancellation field may be applied to the permanent magnet. The cancellation field may at least partially cancel the magnetic field of the permanent magnet. The cancellation field may be created by an electromagnet, such as an electric coil, and/or another permanent magnet. Next in step 806, the permanent magnet may be released from its original location and relocated in the wellbore. The location of the permanent magnet may be monitored via a sensor or any other suitable device. Next in step 808, the method 800 may determine whether a desired new location has been reached. If the condition in the step 808 is satisfied, the method 800 may proceed to step 810. Otherwise, the method 800 may proceed to step 806. In step 810, the cancellation field may be removed by deactivating an electromagnet, such as turning off the current of an electric coil, or changing the pole direction of another permanent magnet. Next in step 812, the permanent magnet may be re-coupled to the structure in the wellbore at the desired new location. It should be noted that a portion of the steps in the method 800, such as step 802, step 804, and step 806, may be executed to retrieve the permanent magnet to the surface of a wellbore, if needed.

Having described the systems and methods disclosed herein, various embodiments may include, but are not limited to:

1. In an embodiment, a magnetic attachment mechanism for use with a downhole tool comprises a plurality of permanent magnets, wherein each permanent magnet of the plurality of permanent magnets has a magnetic field; a demagnetizer configured to at least partially cancel one or more magnetic fields in an activated state; an actuator configured to transition the demagnetizer between the activated state and a deactivated state, or the deactivated state and the activated state; and at least one downhole tool coupled to the plurality of permanent magnets.

2. The magnetic attachment mechanism of embodiment 1, wherein the plurality of permanent magnets are arranged in a radial pattern with a corresponding pole of each magnet aligned at a center of the radial pattern, a matrix pattern with a corresponding pole of each magnet aligned in a parallel direction, or any combination thereof.

3. The magnetic attachment mechanism of embodiment 1 or 2, wherein the plurality of permanent magnets are coupled to a retainer.

4. The magnetic attachment mechanism of embodiment 3, wherein the retainer comprises one or more surface features configured to increase friction with a surface.

5. The magnetic attachment mechanism of any of embodiments 1 to 4, wherein the plurality of permanent magnets are arranged on opposite sides of a clamp mechanism.

6. The magnetic attachment mechanism of embodiment 5, wherein the clamp mechanism is configured to engage a wellbore tubular in the deactivated state.

7. The magnetic attachment mechanism of any of embodiments 1 to 6, wherein the demagnetizer comprises an electric coil configured to form an electromagnet.

8. The magnetic attachment mechanism of any of embodiments 1 to 7, wherein the demagnetizer is configured to at least partially cancel the magnetic fields of a portion of the plurality of permanent magnets in the activated state, and wherein the demagnetizer is configured to at least increase the magnetic fields of a portion of the plurality of permanent magnets in the deactivated state.

9. In an embodiment, a magnetic attachment mechanism for use in a wellbore comprises at least one permanent magnet comprising a first magnetic field; a demagnetizer configured to at least partially cancel the first magnetic field in an activated state; and an actuator configured to transition the demagnetizer between the activated state and a deactivated state, or the deactivated state and the activated state.

10. The magnetic attachment mechanism of embodiment 9, wherein the demagnetizer comprises an electric coil configured to form an electromagnet.

11. The magnetic attachment mechanism of embodiment 10, wherein the electric coil is a bifilar coil.

12. The magnetic attachment mechanism of embodiment 10 or 11, wherein the electric coil is disposed about the at least one permanent magnet.

13. The magnetic attachment mechanism of any of embodiments 10 to 12, further comprising a power source coupled to the demagnetizer, actuator, or both.

14. The magnetic attachment mechanism of any of embodiments 10 to 13, wherein the actuator comprises a switch configured to pass an electric current through the coil in a first direction, pass the electric current through the coil in a second direction, or prevent the electric current from passing through the coil.

15. The magnetic attachment mechanism of embodiment 14, wherein the electric current passing through the coil in the first direction at least partially cancels the first magnetic field, and wherein the electric current passing through the coil in the second direction increases the first magnetic field.

16. The magnetic attachment mechanism of any of embodiments 9 to 15, wherein the demagnetizer comprises a second permanent magnet comprising a second magnetic field.

17. The magnetic attachment mechanism of embodiment 16, wherein the actuator is configured to align the second permanent magnet in a first orientation with respect to the at least one permanent magnet, or a second orientation with respect to the at least one permanent magnet, wherein the first orientation at least partially cancels the first magnetic field, and wherein the second orientation increases the first magnetic field.

18. In an embodiment, a method of coupling a component to a structure in a wellbore comprises applying a cancellation field to a permanent magnet, wherein the cancellation field at least partially cancels a magnetic field of the permanent magnet; removing the cancellation field; and coupling the permanent magnet to a structure in a wellbore.

19. The method of embodiment 18, further comprising: coupling the permanent magnet to a downhole tool, and wherein coupling the permanent magnet to the structure in the wellbore comprises coupling the downhole tool to the structure in the wellbore.

20. The method of embodiment 18 or 19, wherein applying the cancellation field enables disposing of the downhole tool in the wellbore, and wherein removing the cancellation field enables coupling of the downhole tool to the structure in the wellbore.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A magnetic attachment mechanism for use with a downhole tool comprising:

a plurality of permanent magnets having a first magnetic field;

a demagnetizer comprising an electric coil configured to form an electromagnet having a second magnetic field, wherein the second magnetic field of the demagnetizer is configured to at least partially cancel the first magnetic field of the permanent magnets when the demagnetizer is in the activated state, and wherein the second magnetic field of the demagnetizer is configured to increase the first magnetic field of the permanent magnets when the demagnetizer is in the deactivated state;

an actuator configured to transition the demagnetizer between the activated state and a deactivated state, or the deactivated state and the activated state; and at least one downhole tool coupled to the plurality of permanent magnets.

2. The magnetic attachment mechanism of claim 1, wherein the plurality of permanent magnets are arranged in a radial pattern with a corresponding pole of each magnet aligned at a center of the radial pattern, a matrix pattern with a corresponding pole of each magnet aligned in a parallel direction, or any combination thereof.

3. The magnetic attachment mechanism of claim 2, wherein the plurality of permanent magnets are coupled to a retainer.

4. The magnetic attachment mechanism of claim 3, wherein the retainer comprises one or more surface features configured to increase friction with a surface.

5. The magnetic attachment mechanism of claim 1, wherein the plurality of permanent magnets are arranged on opposite sides of a clamp mechanism.

6. The magnetic attachment mechanism of claim 5, wherein the clamp mechanism is configured to engage a wellbore tubular in the deactivated state.

7. A magnetic attachment mechanism for use in a wellbore comprising:

at least one permanent magnet comprising a first magnetic field;

a demagnetizer comprising an electric coil configured to form an electromagnet having a second magnetic field, wherein the second magnetic field of the demagnetizer is configured to at least partially cancel the first magnetic field of the at least one permanent magnet when the demagnetizer is in the activated state, and wherein the second magnetic field of the demagnetizer is configured to increase the first magnetic field of the at least one permanent magnet when the demagnetizer is in the deactivated state; and an actuator configured to transition the demagnetizer between the activated state and a deactivated state, or the deactivated state and the activated state, wherein the permanent magnet is disposed in the wellbore.

8. The magnetic attachment mechanism of claim 7, wherein the electric coil is a bifilar coil.

9. The magnetic attachment mechanism of claim 7, wherein the electric coil is disposed about the at least one permanent magnet.

10. The magnetic attachment mechanism of claim 7, further comprising a power source coupled to the demagnetizer, actuator, or both.

11. The magnetic attachment mechanism of claim 7, wherein the actuator comprises a switch configured to pass an electric current through the coil in a first direction, pass the electric current through the coil in a second direction, or prevent the electric current from passing through the coil.

12. The magnetic attachment mechanism of claim 11, wherein the electric current passing through the coil in the first direction at least partially cancels the first magnetic field, and wherein the electric current passing through the coil in the second direction increases the first magnetic field.

13. The magnetic attachment mechanism of claim 7, wherein the demagnetizer comprises a second permanent magnet comprising a second magnetic field.

14. The magnetic attachment mechanism of claim 13, wherein the actuator is configured to align the second permanent magnet in a first orientation with respect to the at least one permanent magnet, or a second orientation with respect to the at least one permanent magnet, wherein the first orientation at least partially cancels the first magnetic field, and wherein the second orientation increases the first magnetic field.

* * * * *